US010234186B1

(12) United States Patent
Koh et al.

(10) Patent No.: US 10,234,186 B1
(45) Date of Patent: Mar. 19, 2019

(54) APPARATUS FOR MANUFACTURING POWDERED ICE WITH SALINITY

(71) Applicants: James Chun Koh, Fort Lee, NJ (US); Shigeaki Sakaguchi, Saitama (JP); Masaaki Shimizu, Tokyo (JP)

(72) Inventors: James Chun Koh, Fort Lee, NJ (US); Shigeaki Sakaguchi, Saitama (JP); Masaaki Shimizu, Tokyo (JP)

( * ) Notice: Subject to any disclaimer, the term of this patent is extended or adjusted under 35 U.S.C. 154(b) by 0 days.

(21) Appl. No.: 15/808,824

(22) Filed: Nov. 9, 2017

(51) Int. Cl.
*F25C 1/12* (2006.01)
*F25C 3/00* (2006.01)

(52) U.S. Cl.
CPC ..... *F25C 3/00* (2013.01); *F25C 1/12* (2013.01); *F25C 2303/048* (2013.01)

(58) Field of Classification Search
CPC ..... F25C 3/00; F25C 1/12; F25C 2303/048; F25C 5/00; F25C 5/18; F25C 5/182; F25C 5/185; F25C 2301/002
See application file for complete search history.

(56) References Cited

U.S. PATENT DOCUMENTS 2,009,283 A * 7/1935 Warner ..... F25C 1/16 62/268
3,049,889 A * 8/1962 Carfagno ..... B01D 9/04 62/537
3,232,218 A * 2/1966 Soussloff ..... C02F 1/22 100/37
3,788,566 A * 1/1974 Morris, Jr. ..... F25C 5/00 241/73
3,803,860 A * 4/1974 Nagashima ..... C02F 1/22 62/535
3,859,069 A * 1/1975 Seliber ..... C02F 1/22 62/537
4,262,489 A * 4/1981 Sakamoto ..... C02F 1/22 62/124
4,292,816 A * 10/1981 Gartzke ..... F25C 1/10 62/345
4,448,032 A * 5/1984 Hibino ..... C02F 1/22 414/269
4,544,304 A * 10/1985 Fisher ..... E01C 7/06 404/17
4,833,897 A * 5/1989 Burns ..... F25C 5/00 62/330
4,894,077 A * 1/1990 Simon ..... F25C 1/00 62/434

(Continued)

FOREIGN PATENT DOCUMENTS

JP 09108455 A * 4/1997
KR 10-0498735 7/2005
WO WO-2012104787 A1 * 8/2012 ..... C02F 1/22

*Primary Examiner* — Kun Kai Ma
(74) *Attorney, Agent, or Firm* — LEEPI

(57) ABSTRACT

There is provided an apparatus for manufacturing powdered ice with salinity includes a water supply unit configured to supply a salted water; a spraying unit connected to the water supply unit and configured to generate a pressurized salted water-air mist; an ice generating unit connected to the spraying unit and configured to generate ice nuclei; a collecting unit connected to the ice generating unit and configured to grow the size of the powdered ice and to collect the powdered ice; and a reserving unit connected to the collecting unit and configured to transfer and store the powdered ice.

12 Claims, 6 Drawing Sheets

(56) References Cited

U.S. PATENT DOCUMENTS

| | | | | |
|---|---|---|---|---|
| 5,502,470 | A * | 3/1996 | Miyashita | B41J 2/1606 347/45 |
| 5,571,232 | A * | 11/1996 | Davis | C09K 5/06 62/330 |
| 5,829,255 | A * | 11/1998 | Sitnyakovsky | F01K 9/003 60/688 |
| 6,305,189 | B1 * | 10/2001 | Menin | A23L 3/361 62/544 |
| 6,440,317 | B1 * | 8/2002 | Koethe | B01D 17/0217 210/774 |
| 6,508,412 | B1 | 1/2003 | Pergay et al. | |
| 6,793,007 | B1 * | 9/2004 | Kramer | C09K 5/10 165/80.4 |
| 2002/0144608 | A1 * | 10/2002 | Jones | A23G 9/22 99/517 |
| 2004/0003621 | A1 * | 1/2004 | Zevlakis | F25C 1/04 62/352 |
| 2004/0093888 | A1 * | 5/2004 | Willamor | B63J 2/12 62/344 |
| 2005/0089458 | A1 * | 4/2005 | Oke | A61L 2/202 422/207 |
| 2007/0012065 | A1 * | 1/2007 | Schock | F41H 9/06 62/425 |
| 2007/0267086 | A1 * | 11/2007 | Dunn | G07F 11/58 141/2 |
| 2012/0273337 | A1 * | 11/2012 | Wofsey | B01D 1/0035 203/10 |
| 2013/0291581 | A1 * | 11/2013 | Cox | F25C 5/06 62/340 |
| 2015/0083374 | A1 * | 3/2015 | Clark, III | F25D 17/02 165/104.31 |
| 2015/0118401 | A1 * | 4/2015 | Baker | E04D 15/04 427/355 |
| 2017/0190597 | A1 * | 7/2017 | Lissianski | C02F 1/22 |

* cited by examiner

APPARATUS FOR MANUFACTURING POWDERED ICE WITH SALINITY

FIELD OF THE INVENTION

The present disclosure relates to an apparatus for manufacturing powdered ice with salinity.

BACKGROUND OF THE INVENTION

Generally, the ice used in seafood refrigeration industries are made from 100% fresh water or 100% sea water.

Small and medium sized fishing vessels are provided with the ice from the ice storage on the land, and some are supplied with the ice from an ice supply line at sea. In this case, it takes a lot of cost to maintain the freshness of the fish caught due to receiving the ice from the off-shore.

In addition, the freezing point of the ice with 100% fresh water is 0° C., but having a drawback that freshness is deteriorated due to osmotic phenomenon from the fish muscle. On the other hand, the frozen ice with 100% of seawater is excellent in precooling, but it is required a special facility to produce the ice using seawater.

The ice currently used for cooling of seafood preservation such as ice cube or sherbet ice contain a large amount of moisture and it causes swelling or deterioration of fish. Moreover, due to the size and the shape of ice itself, the contact area of the ice to the seafood is not even, resulting in local temperature variation at each point of contact. More specifically, when the ice is in contact with a fish, the muscle of the fish is damaged due to the temperature is too lower than desired preservation temperature because of the direct contact of the ice. On the other hand, the temperature of other area of fish where is not in direct contact with ice is not precisely controlled and sometimes above the desired temperature because the air is in the way and blocks the cool temperature dispersion from the ice to the fish. Thus the best outcome of seafood preservation is preferably achievable when using the fine particle ice type, more like powdered or snow shaped ice.

In addition, the one of the critical aspect of the powdered ice is to control the quality of water. The salinity in the water is maintained so that it contains same percentage of salt as sea water. When the powdered ice with same salinity as sea water is used in seafood preservation, its environmental condition is as closely same as in the sea, making the seafood is in more natural condition that minimize and slow down any deterioration process occurring in seafood when time elapses and prolongs the preservation period.

There was an artificial snow machine device as a coolant in U.S. Pat. No. 6,508,412 B1. But this prior art disclosed as a snow maker is normally used for creating snow for skiing and other recreational purpose. Also, this kind of snow maker did not control the size, quality of snow and its water source, which is considered as very important factors when using the powdered ice in seafood preservation industries. And the snow made from the artificial snow machine does not contain salinity.

In this regard, Korean Patent No. 10-0498735 disclosed a device for manufacturing seawater ice, but the ice maker according to the related art instantly crushed the ice after generating it, which disclosed the different apparatus and still producing coarse ice as an outcome.

BRIEF SUMMARY OF THE INVENTION

It is an object of the present invention to provide an apparatus for manufacturing powdered ice with salinity that maintains the freshness of seafood.

In accordance with an illustrative embodiment, there is provided an apparatus for manufacturing powdered ice with salinity that includes a water supply unit configured to supply a salted water; a spraying unit connected to the water supply unit and configured to generate a pressurized salted water-air mist; an ice generating unit connected to the spraying unit and configured to generate ice nuclei; a collecting unit connected to the ice generating unit and configured to grow the size of the powdered ice and to collect the powdered ice; and a reserving unit connected to the collecting unit and configured to transfer and store the powdered ice.

According to the means of the present invention, the water supply unit comprises a water tank configured to receive and store a water from a water source, a salt provider configured to insert salt into the water tank and maintain water salinity to be same as sea water, a heater attached to the water tank and configured to maintain the water temperature, and a supply pump attached to an outlet line of the water tank and configured to pressurize and transfer the salted water to the spraying unit.

According to the means of the present invention, the spraying unit comprises an air compressor connected to an inlet line of the spraying unit configured to supply a compressed air therein, a smoke generator connected the inlet line of the spraying unit configure to supply a smoke therein, and a spraying nozzle connected to an end of the inlet line of the spraying unit. The spraying unit generates and provides the pressurized salted water-air mist into the ice generating unit.

According to the means of the present invention, the ice generating unit comprises an ice chamber configured to house the spraying nozzle, a freezing unit configured to provide a freezing air into the ice chamber and maintain the freezing temperature of the ice chamber, and a splatting wall attached inside the space of the ice chamber and configured to disperse the pressurized salted water-air mist sprayed from the spraying nozzle. The ice chamber has an air inlet to flow the freezing air therein and the splatting wall is set to an angle in the flow direction of the pressurized salted water-air mist to effectively generate the ice nuclei.

According to the means of the present invention, the collecting unit comprises a funnel chamber connected to the ice chamber and configured to collect the powdered ice, and a plurality of scrapers configured to detach the powdered ice on an inner surface of the funnel chamber. The funnel chamber is formed as a cone shape to generate swirling air flow motion therein to move the powdered ice downward, and contains a plurality of holes located along an inner surface of a cone shape to evacuate the freezing air therein. The plurality of holes is formed to hold the powdered ice inside the funnel chamber and evacuate only the freezing air therein.

According to the means of the present invention, the reserving unit comprises a feeder connected to an end of the collecting unit and configured to transfer the powered ice, and a cooling storage connected an end of the feeder and configured to store the powdered ice and maintain the freezing temperature to prevent ice meltage.

According to the means of the present invention, inner surface of the ice generating unit and the collecting unit are shaped and coated with fluoropolymer to prevent powdered ice adhesion thereon.

According to the means of the present invention, the pressurized salted water-air mist is formed as a plurality of fine particles to generate an ice nuclei. Also, a plurality of particles from the smoke generator is used to form the ice nuclei faster.

According to the means of the present invention, an inner surface of the reserving unit is coated by anti-condensation material to prevent melting of the powdered ice due to any water from condensation thereon.

According to the means of the present invention, it is possible to generate an ice nuclei, to grow the size of ice, and to store outcome by spraying pressurized water-air mist into a chamber with a freezing temperature environment therein, producing powdered ice that can preserve the freshness of seafood without damage.

In addition, the present invention can produce powdered ice having various functions such as ice containing fruit juice, ice containing animal collagen and the like, fragrant ice using gas and liquid perfume.

BRIEF DESCRIPTION OF THE DRAWINGS

Non-limiting and non-exhaustive embodiments will be described in conjunction with the accompanying drawings. Understanding that these drawings depict only several embodiments in accordance with the disclosure and are, therefore, not to be intended to limit its scope, the disclosure will be described with specificity and detail through use of the accompanying drawings, in which.

DETAILED DESCRIPTION OF THE INVENTION

Figure 1:
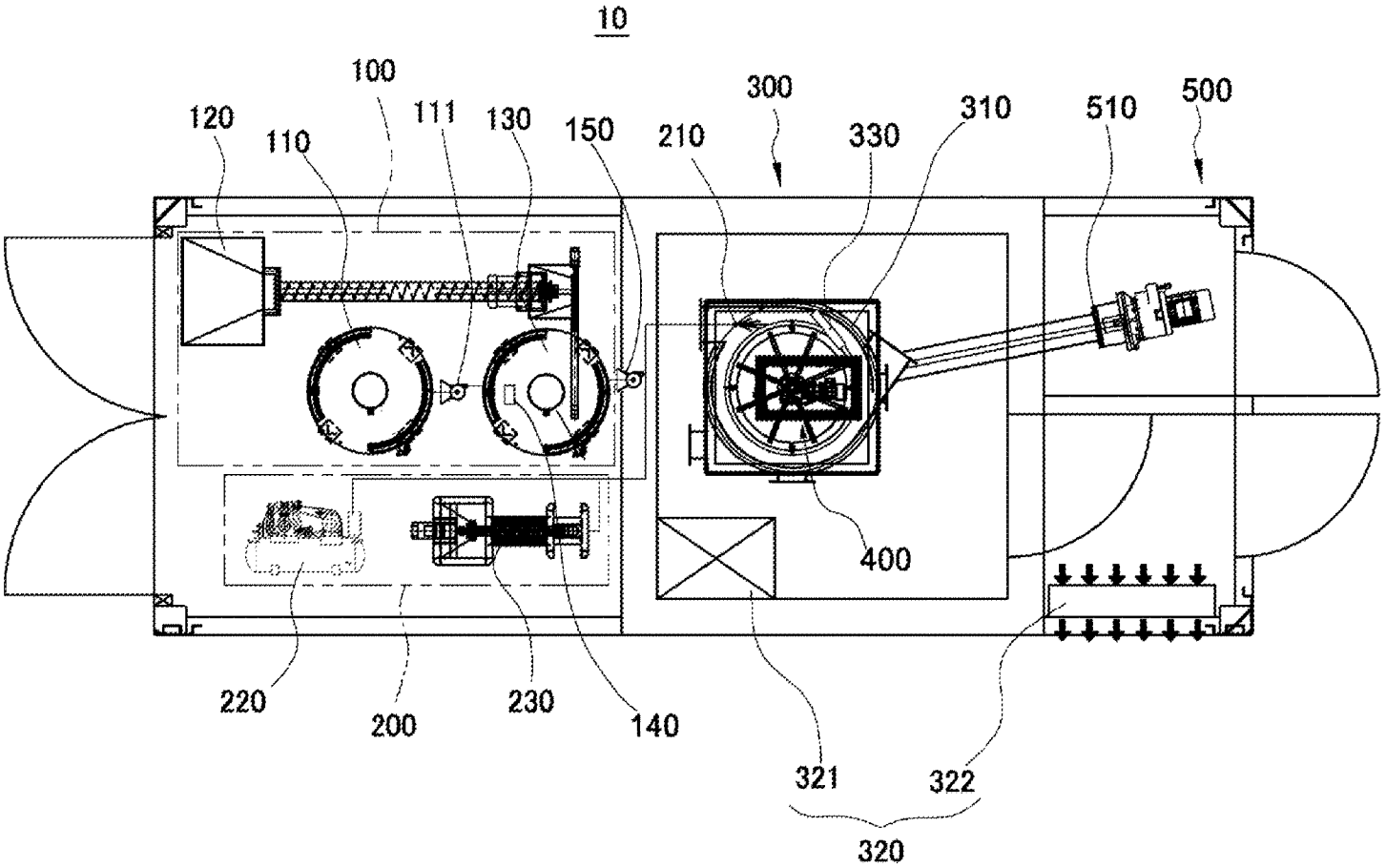
FIG. 1 is a plane view of the apparatus for manufacturing powdered ice with salinity in accordance with an illustrative embodiment.

Hereinafter, illustrative embodiments of the present disclosure will be described in detail with reference to the accompanying drawings so that inventive concept may be readily implemented by those skilled in the art. However, it is to be noted that the present disclosure is not limited to the illustrative embodiments but can be realized in various other ways. In the drawings, certain parts not directly relevant to the description are omitted to enhance the clarity of the drawings, and like reference numerals denote like parts throughout the whole document.

Throughout the whole document, the term "comprises or includes" and/or "comprising or including" used in the document means that one or more other components, steps, operations, and/or the existence or addition of elements are not excluded in addition to the described components, steps, operations and/or elements.

Throughout the whole document, the term "on" that is used to designate a position of one element with respect to another element includes both a case that the one element is adjacent to the another element and a case that any other element exists between these two elements.

Further, the term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for."

Hereinafter, illustrative embodiments will be described in detail.

Figure 2:
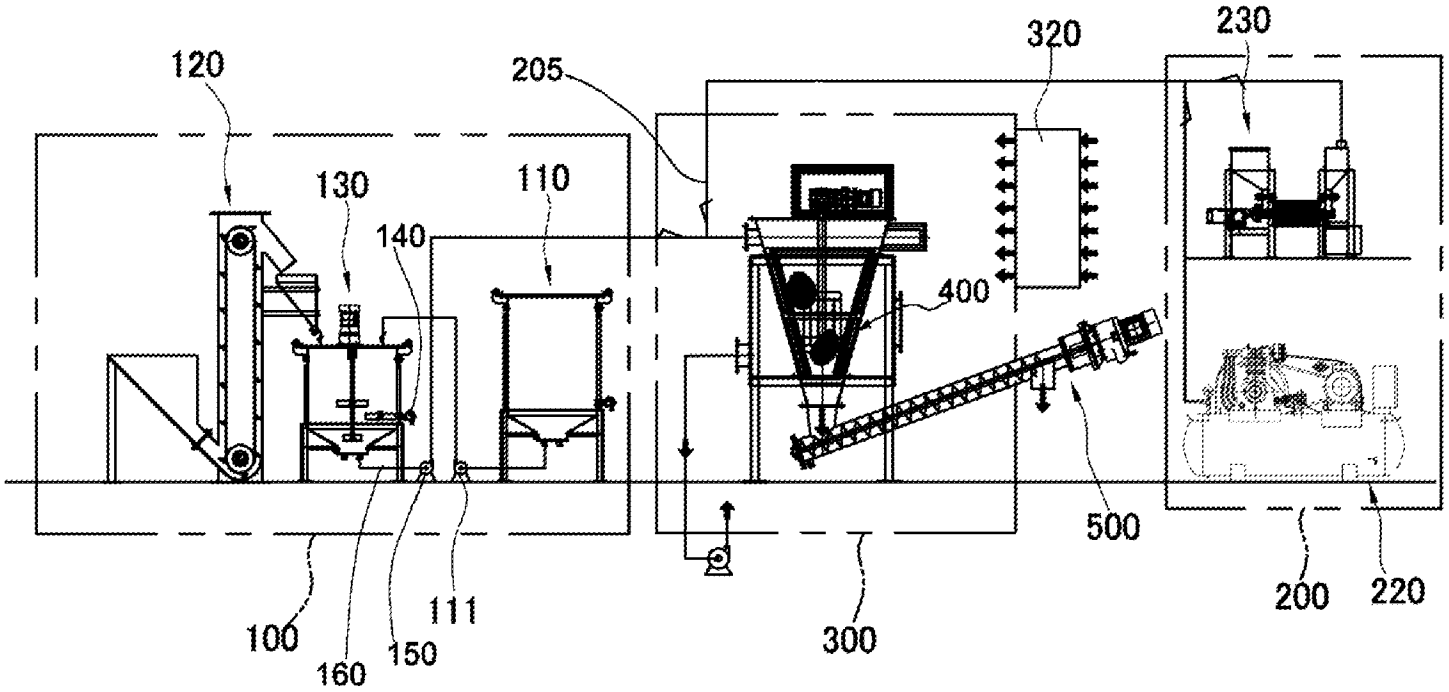
FIG. 2 is a front view of the apparatus for manufacturing powdered ice with salinity in accordance with an illustrative embodiment.
Figure 3:
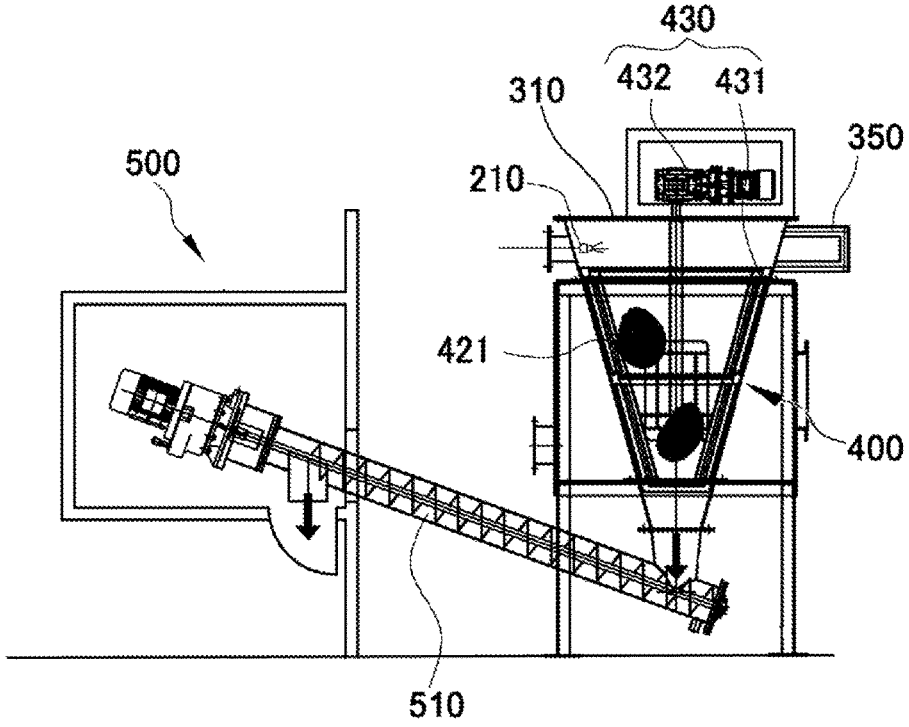
FIG. 3 is a detailed view of the ice generating unit and the collecting unit of the apparatus for manufacturing powdered ice with salinity in accordance with an illustrative embodiment.
Figure 4:
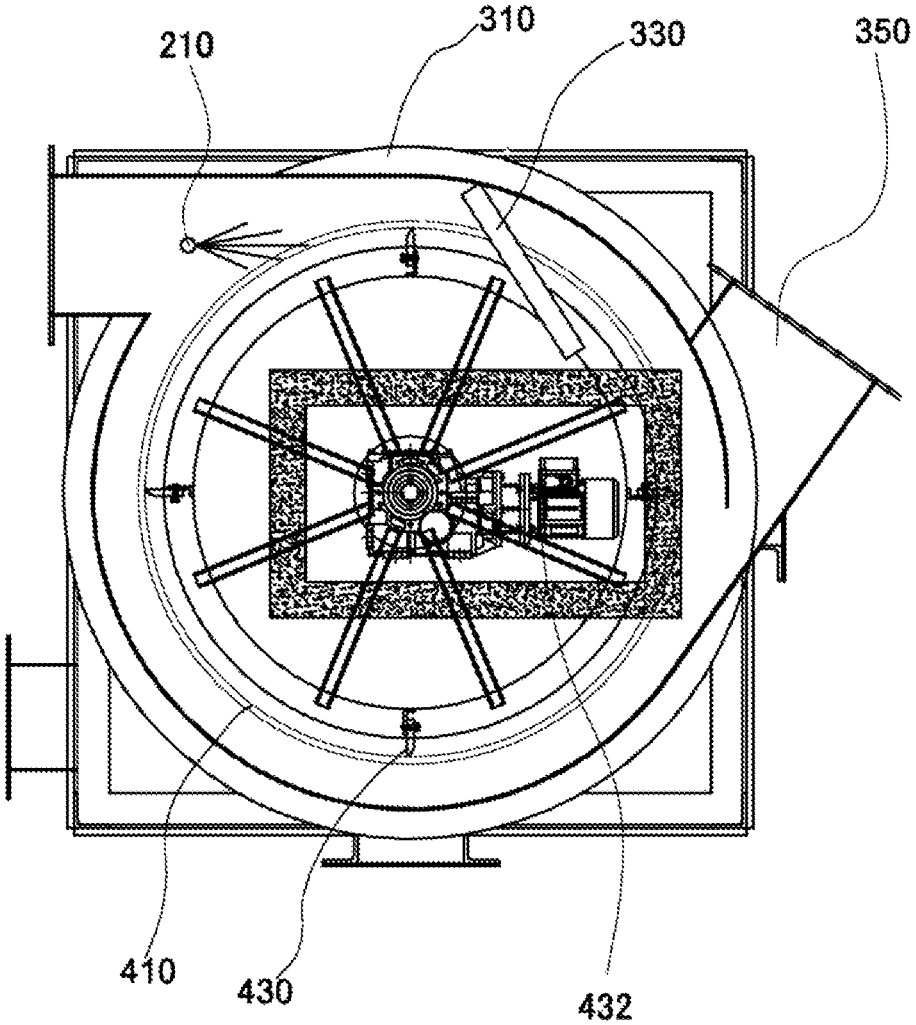
FIG. 4 is a front view of the ice generating unit of the apparatus for manufacturing powdered ice with salinity in accordance with an illustrative embodiment.
Figure 5:
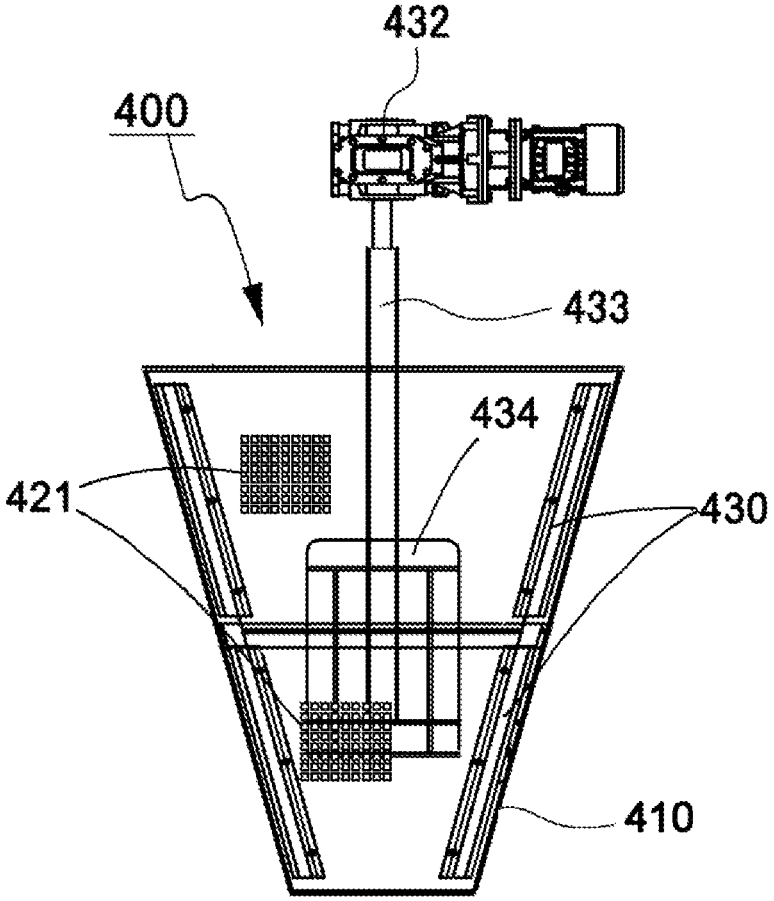
FIG. 5 is a detailed view of the collecting unit of the apparatus for manufacturing powdered ice with salinity in accordance with an illustrative embodiment.
Figure 6:
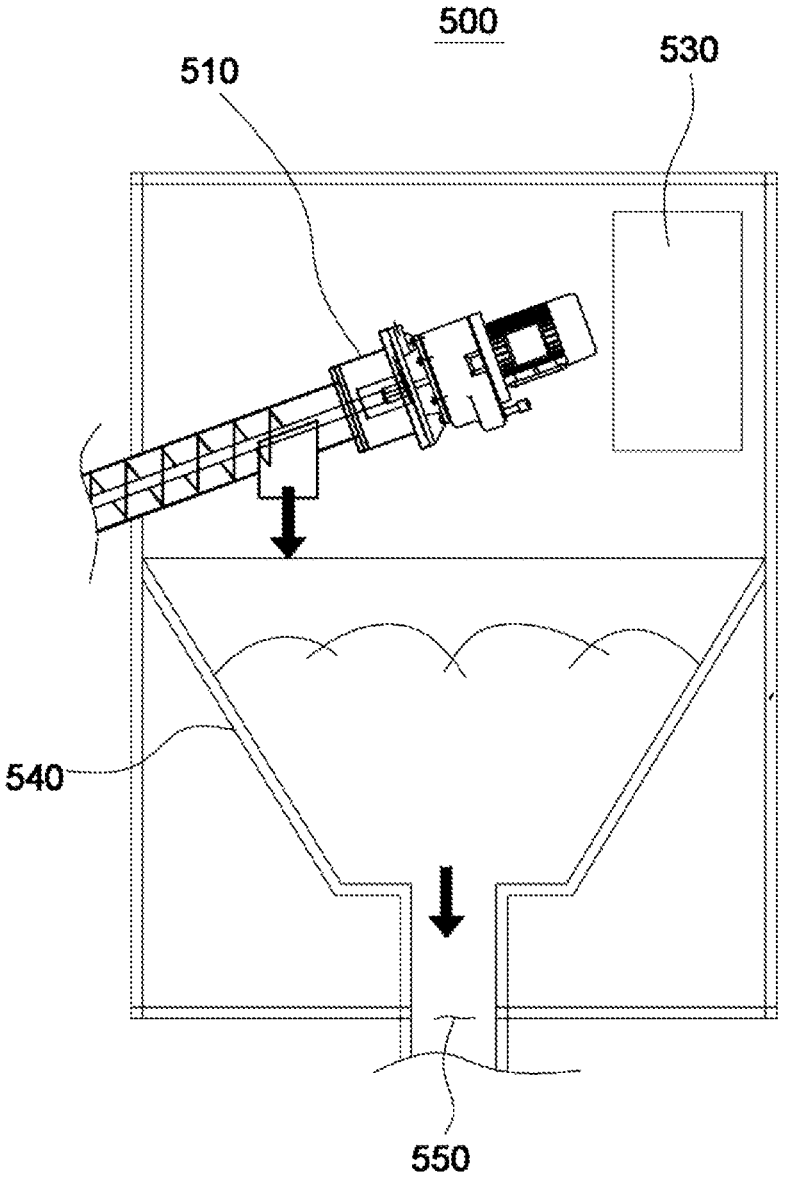
FIG. 6 is a detailed view of the reserving unit of the apparatus for manufacturing powdered ice with salinity in accordance with an illustrative embodiment.

In accordance with the illustrative embodiment, FIG. 1 is a plane view of the apparatus for manufacturing powdered ice with salinity, FIG. 2 is a front view of the apparatus for manufacturing powdered ice, FIG. 3 is a detailed view of the ice generating unit and the collecting unit of the apparatus for manufacturing powdered ice with salinity, FIG. 4 is a front view of the ice generating unit of the apparatus for manufacturing powdered ice with salinity, FIG. 5 is a detailed view of the collecting unit of the apparatus for manufacturing powdered ice with salinity, and FIG. 6 is a detailed view of the reserving unit of the apparatus for manufacturing powdered ice with salinity.

Firstly, in accordance with the illustrative embodiment, the apparatus for manufacturing powdered ice with salinity (10) (the powder ice manufacturing apparatus (10) hereafter) is described in detail.

Referring to FIG. 1 and FIG. 2, the powder ice manufacturing apparatus (10) includes a water supply unit (100), a spraying unit (200), an ice generating unit (300), a collecting unit (400), and a reserving unit (500). The powdered ice may be formed to snow-like shape, but is not limited thereto.

The water supply unit (100) supplies the water of which the temperature and salinity are controlled.

Referring to FIG. 1 and FIG. 2, the water supply unit (100) includes a water tank (110) configured to receive and store a water from a water source, a salt provider (120) configured to insert salt into the water tank (110) having a predetermined salt concentration, a heater (140) attached to the water tank (110) and configured to maintain the water temperature at predetermined value inside the water tank, and a supply pump (150) attached to an outlet line of the water tank (160) and configured to pressurize and transfer the salted water to the spraying unit (200).

Another possible configuration of the water supply unit (100) may include a stirring tank (130) to separate the water from the water source such that the water tank (110) temporarily stores the water and the stirring tank (130) controls the water in terms of the salinity and temperature through the salt from the salt provider (120) and the temperature of the water by the heater (140) attached to the stirring tank (130). In other words, the stirring tank (130) receives water from the water tank (110) and receives the salt from the salt provider (120) to generate the water having a predetermined salt concentration, preferably same salt concentration as seawater. At this time, the stirring tank (130) is heated to a predetermined temperature, preferably 40° C. by the heater (140) so that the salt can be dissolved in the water smoothly. Further, the water having a predetermined salt concentration generated in the stirring tank (130) can be supplied to the spraying unit (200) through the supply pump (150).

The water supply unit (100) may further includes a nano-bubble generator to manufacture the powdered ice more effectively.

Referring FIG. 1 and FIG. 2, the spraying unit (200) generates and provides a pressurized salted water-air mist into the ice generating unit (300).

The spraying unit (200) includes an air compressor (220) connected to an inlet line of the spraying unit (205) configured to supply a compressed air therein, a smoke generator (230) connected the inlet line of the spraying unit (205) configure to supply a smoke therein, and a spraying nozzle (210) connected to an end of the inlet line of the spraying unit (205).

Specifically, the spraying unit (200) sprays the pressurized water from the water supply unit (100) and the air from the air compressor (220) simultaneously into the ice generating unit (300).

The water and the air is formed as the pressurized salted water-air mist through the spray nozzle (210). The pressurized salted water-air mist is formed as a plurality of fine particles to generate an ice nuclei. Also, a plurality of particles from the smoke generator (230) is used to form the ice nuclei faster.

An inner surface of the spraying unit (300) is coated by fluoropolymer to generate smooth spraying of the pressurized salted water-air mist and prevent ice adhesion thereon.

Referring FIG. 3, FIG. 4, and FIG. 5, the ice generating unit (300) and the collecting unit (400) are disclosed in detail.

The ice generating unit (300) comprises an ice chamber (310) configured to house the spraying nozzle (210), a freezing unit (320) configured to provide a freezing air into the ice chamber (310) and maintain the freezing temperature inside the ice chamber, and a splatting wall (330) attached inside the space of the ice chamber (310) and configured to disperse the pressurized salted water-air mist sprayed from the spraying nozzle (210).

A room to house ice generating unit (300) may have a space formed therein with a heat insulating material so that freezing air is not leaked to the outside.

The freezing unit (320) includes an outdoor condensing unit (322) to cool the inside of the ice chamber (310) and a freezer (321) that supplies the air cooled from the outdoor condensing unit (322) to the ice chamber (310). The freezing unit (320) is controlled to maintain the ice chamber (310) at a temperature of −30° C.

The ice chamber (310) has a cooling air inlet (350) to flow the freezing air therein. The pressurized salted water-air mist sprayed into the ice chamber (310) can be formed into ice nuclei by the freezing air flowed through the cooling air inlet (350).

The ice chamber (310) may be formed in a cylindrical shape. In addition, the spray nozzle (210) may be positioned so that the pressurized salted water-air mist is sprayed to be parallel to the tangent of the peripheral surface of the ice chamber (310). Accordingly, the pressurized salted water-air mist sprayed from the spray nozzle (210) collides with the splatting wall (330) installed at an angle in the flow direction of the pressurized salted water-air mist to effectively generate the ice nuclei in the ice chamber (310). [0045] the collecting unit (400) comprises a funnel chamber (410) connected to the ice chamber (310) and configured to grow and collect the powdered ice, and a plurality of scrapers (430) configured to detach the powdered ice on an inner surface of the funnel chamber (410).

Inside the funnel chamber (410), the ice nuclei generated in the ice chamber (310) can be grown into the powdered ice.

The funnel chamber (410) is formed as a cone shape to generate swirling air flow motion therein to move the powdered ice downward and includes a plurality of holes (421) (shown in black colored area in FIG. 2 and FIG. 3) located along an inner surface of a cone shape, and a plurality of scrapers (430) for scraping the powdered ice generated on the surface of the funnel chamber (410).

In addition, the plurality of holes (421) is formed to hold the powdered ice inside the funnel chamber (420) and evacuates only the freezing air therein.

Illustratively, the plurality of holes (421) is formed so that air and ice can be separated by the cyclone swirling effect. In addition, the plurality of scrapers (430) can move the powdered ice downward by scraping them on the inner surface of the funnel chamber (410) without clogging the plurality of holes (421).

In FIG. 5, the collecting unit (400) further includes a scraper motor (432), a rotating shaft (433) connected to the scraper motor (432). A plurality of link portions (434) formed so as to be spaced apart from each other by a predetermined distance to connect the plurality of scrapers (430). The plurality of scrapers (430) may be made of a soft material so that the plurality of the holes (421) is not damaged.

An inner surface of the ice generating unit (300) and the collecting unit (400) is coated with a fluoropolymer so that the generated powdered ice is prevented from adhering to thereon.

Referring to FIG. 6, the reserving unit (500) can transfer and store the generated powdered ice from the collecting unit (400).

In detail, the reserving unit (500) includes a feeder (510) connected to an end of the collecting unit (400) and configured to transfer the powered ice, and an ice storage (520) at an end of the feeder (510) and configured to store the generated powdered ice.

The reserving unit (500) may further include a refrigeration system (530). The refrigeration system (530) can freeze the inside of the reserving unit (500). Illustratively, the refrigeration system (530) is driven such that the ice storage (500) is maintained at a temperature of −5° C. In addition, the refrigeration system (530) may be used from the freezing unit (320) of the ice chamber (300) or separately installed inside the reserving unit (500).

The discharging device (550) may discharge the powdered ice stored in the storage (540) to the outside.

An inner surface of the reserving unit (500) is coated by anti-condensation material to prevent melting of the powdered ice due to any water from condensation thereon.

The above description of the illustrative embodiments is provided for the purpose of illustration, and it would be understood by those skilled in the art that various changes and modifications may be made without changing technical conception and essential features of the illustrative embodiments. Thus, it is clear that the above-described illustrative embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the illustrative embodiments. It shall be understood that all modifications and embodiments conceived from the meaning and scope of the claims and their equivalents are included in the scope of the inventive concept.

What is claimed is:

1. An apparatus for manufacturing powdered ice containing salinity, comprising:

a water supply unit configured to supply a salted water;

a spraying unit connected to the water supply unit and configured to generate a pressurized salted water-air mist;

an ice generating unit connected to the spraying unit and configured to generate ice nuclei;

an collecting unit connected to the ice generating unit and configured to grow the size of the powdered ice and to collect the powdered ice; and a reserving unit connected to the collecting unit and configured to transfer and store the powdered ice;

wherein the collecting unit comprises:

a funnel chamber connected to an the ice chamber and configured to collect the powdered ice; and a plurality of scrapers configured to detach the powdered ice on an inner surface of the funnel chamber;

wherein the funnel chamber is formed as a cone shape to generate swirling air flow motion therein to move the powdered ice downward, and contains a plurality of holes located along an inner surface of a cone shape to evacuate the freezing air therein, and wherein the plurality of holes is formed to hold the powdered ice inside the funnel chamber and evacuate only the freezing air therein.

2. The apparatus of claim 1, wherein the water supply unit comprises:

a water tank configured to receive and store a water from a water source;

a salt provider configured to insert salt into the water tank and maintain water salinity to be same as sea water;

a heater attached to the water tank and configured to maintain the water temperature; and a supply pump attached to an outlet line of the water tank and configured to pressurize and transfer the salted water to the spraying unit.

3. The apparatus of claim 1, wherein the spraying unit comprises:

an air compressor connected to an inlet line of the spraying unit configured to supply a compressed air therein;

a smoke generator connected the inlet line of the spraying unit configure to supply a smoke therein; and a spraying nozzle connected to an end of the inlet line of the spraying unit.

4. The apparatus of claim 3, wherein the spraying unit generates and provides the pressurized salted water-air mist into the ice generating unit.

5. The apparatus of claim 1, wherein the ice generating unit comprises:

an ice chamber configured to house the spraying nozzle;

a freezing unit configured to provide a freezing air into the ice chamber and maintain the freezing temperature of the ice chamber; and a splatting wall attached inside the space of the ice chamber and configured to disperse the pressurized salted water-air mist sprayed from the spraying nozzle.

6. The apparatus of claim 5, wherein the ice chamber has an air inlet to flow the freezing air therein; and wherein the splatting wall is set to an angle in the flow direction of the pressurized salted water-air mist to effectively generate the ice nuclei.

7. The apparatus of claim 1, wherein the reserving unit comprises:

a feeder connected to an end of the collecting unit and configured to transfer the powered ice; and a cooling storage connected an end of the feeder and configured to store the powdered ice and maintain the freezing temperature to prevent ice meltage.

8. The apparatus of claim 1, wherein an inner surface of the spraying unit is coated with fluoropolymer to generate smooth spraying of the pressurized salted water-air mist and prevent powdered ice adhesion thereon.

9. The apparatus of claim 1, wherein inner surface of the ice generating unit and the collecting unit are shaped and coated with fluoropolymer to prevent powdered ice adhesion thereon.

10. The apparatus of claim 1, wherein the pressurized salted water-air mist is formed as a plurality of fine particles to generate an ice nuclei.

11. The apparatus of claim 1, wherein a plurality of particles from a smoke generator is used to form the ice nuclei faster.

12. The apparatus of claim 1, wherein an inner surface of the reserving unit is coated by anti-condensation material to prevent melting of the powdered ice due to water from condensation thereon.

* * * * *